US005799819A

United States Patent [19]

Nimer

[11] Patent Number: 5,799,819

[45] Date of Patent: Sep. 1, 1998

[54] STEPLADDER UTILITY BASKET

[76] Inventor: Fred Nimer, 1325 Swailes Rd., Troy, Ohio 45373

[21] Appl. No.: 730,126

[22] Filed: Oct. 15, 1996

[51] Int. Cl.[6] ..... B65D 25/28

[52] U.S. Cl. ..... 220/694; 220/756; 220/481

[58] Field of Search ..... 200/756, 770, 200/694, 481; 248/211

[56] References Cited

U.S. PATENT DOCUMENTS

| | | | |
|---|---|---|---|
| 2,508,258 | 7/1950 | Hginrich | 220/756 |
| 3,292,815 | 12/1966 | Smith et al. | 220/756 |
| 4,205,411 | 1/1980 | Cupp et al. | 220/756 |
| 5,234,144 | 8/1993 | Iler | 220/756 |
| 5,276,943 | 1/1994 | Ludy | 220/756 |
| 5,402,910 | 4/1995 | Pilney | 220/756 |
| 5,447,252 | 9/1995 | Ward | 220/756 |

*Primary Examiner*—Joseph M. Moy
*Attorney, Agent, or Firm*—William Weigl

[57] ABSTRACT

A utility basket for supporting tools and materials is positioned atop a stepladder for assisting in performing work tasks from the ladder without requiring frequent ascent and descent. A simple means of stably mounting and easily demounting the basket relative to the ladder is described. Shipment advantages are also achievable with the preferred form of the invention.

3 Claims, 2 Drawing Sheets

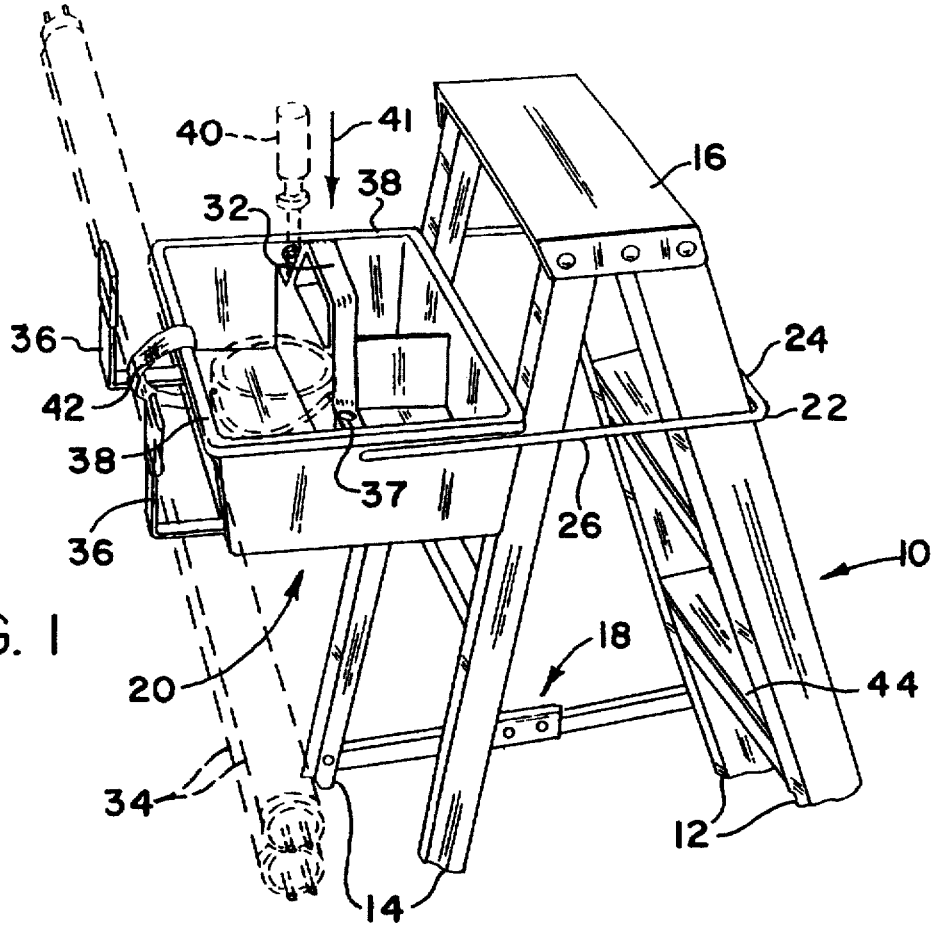
FIG. 1
FIG. 2
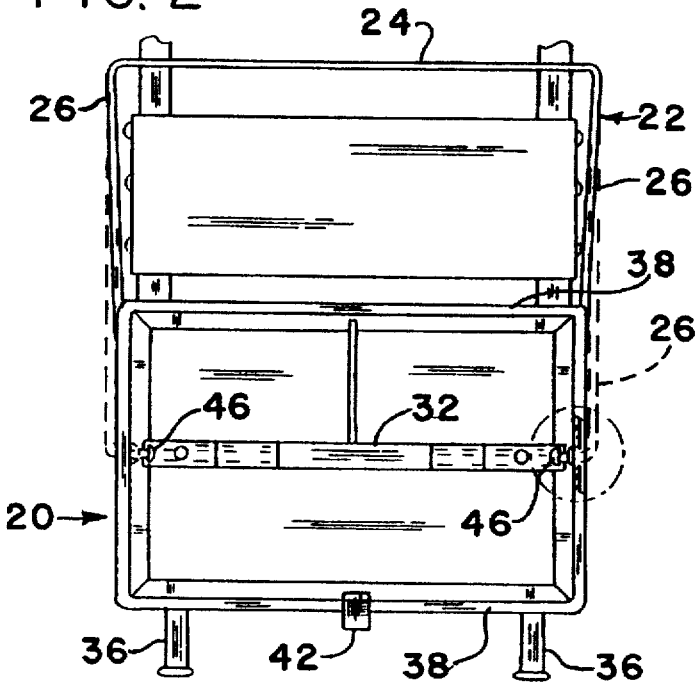
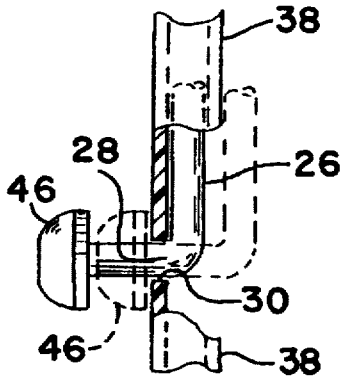
FIG. 3

STEPLADDER UTILITY BASKET

This invention relates generally to a utility basket for carrying tools, materials and a large variety of other items to and from a stepladder, placing it over and supporting it at the top end of the ladder, and using the basket to hold the contents while performing work tasks from a step of the stepladder. Specifically, the invention relates to such a basket which is stably supported on a stepladder on that side thereof opposite the side on which the person performing the work is standing, so that the tools and materials are easily reachable directly in front of the person, approximately at waist level. This application is based on original U.S. Provisional Patent Application 60/007,311 filed Nov. 6, 1995.

BACKGROUND OF THE INVENTION

Various kinds of platforms and containers for use on stepladders and extension ladders for the purposes mentioned above are known. Perhaps the most common type of stepladder is one which has its front and rear legs parallel and together when in a non-use condition, a pair of hinged braces near its upper end to lock the legs in a spread condition during use, and a flat platform connected to the hinge so as to stand outwardly in a horizontal direction on the side of the ladder opposite the user when the ladder legs are spread. The flat platform, while being of value for supporting gallons of paint, trays used in conjunction with paint rollers, rags, and to some lesser extent, tools, is of limited use only. Long objects (such as fluorescent lamps to be replaced in a ceiling fixture) cannot be adequately supported on such a platform at all, at least not without substantial risk of falling off the platform and breaking.

Some stepladder designs have no such platform, requiring a person to normally go up and down the ladder frequently if performing a task that requires repetitive installation or removal of multiple items from the same position of the ladder, unless, of course, the person is wearing an apron or tool-supporting belt. Even with an apron or belt, if something like a fluorescent tube is to be replaced, the person must first go up the ladder to remove the fixture cover or place it aside and remove the bad tube, descend with the faulty tube, exchange it for one at the floor level and then make a second trip up the ladder to install the new tube and replace the cover. If two lamps require placement in the same fixture, four separate round trips up and down the ladder would ordinarily be made. Not only is this time consuming, but every ascent and descent of the steps increases the chances of an accident on the way up or down, particularly if the job being performed is a frustrating or time-consuming one, or if the person is attempting to act too rapidly because he is in a hurry. Additionally, when moving the ladder from one location to another, as when painting a wall or ceiling, anything on the standard platform should be removed before the ladder is moved to prevent its falling or spilling.

Baskets and tool-supporting devices of various kinds have been known in the patent art to have been hung from the rungs of extension ladders and at the sides of or on the tops of stepladders for utility use. The desirability of doing this has long been recognized, not only to have a tool or material handy when needed, but also to avoid the incessant and unnecessary up and down trips.

SUMMARY OF THE INVENTION

A utility basket with a carrying handle is provided with a pivotally-mounted bail for simple one-hand placement over the upper end of a stepladder to support the basket on the side of the ladder opposite a person standing on a step or steps of the ladder and performing work tasks therefrom. The basket is transported to and from the ladder by means of its carrying handle, since the contents of the basket may cause it to be unbalanced. Being pivotable, the bail is ordinarily inhibited from being used as a basket-carrying handle. Instead, the bail is used primarily to straddle the stepladder at its upper end and firmly support the basket in a very stable condition on the side of the user opposite the side having the steps. The stable condition continues so long as the basket remains in place, such as when moving the ladder from one work location to another without collapsing its legs. The bail is also useful to provide for a stable shipment of baskets in pairs, by interlocking the bails of two baskets in a unique side-by-side manner.

DESCRIPTION OF THE DRAWINGS

FIG. 1 is an isometric view of a basket supported at the upper end of one conventional type of stepladder.

FIG. 2 is a plan view of a basket with its bail at one side thereof, as it is placed over and on a stepladder.

FIG. 3 is an enlarged fragmentary view of the manner of connecting the bail to a basket, this figure being essentially the same as that shown within the dot-dash circle 3 at the right of FIG. 2.

DESCRIPTION OF THE PREFERRED EMBODIMENT

Figure 4:
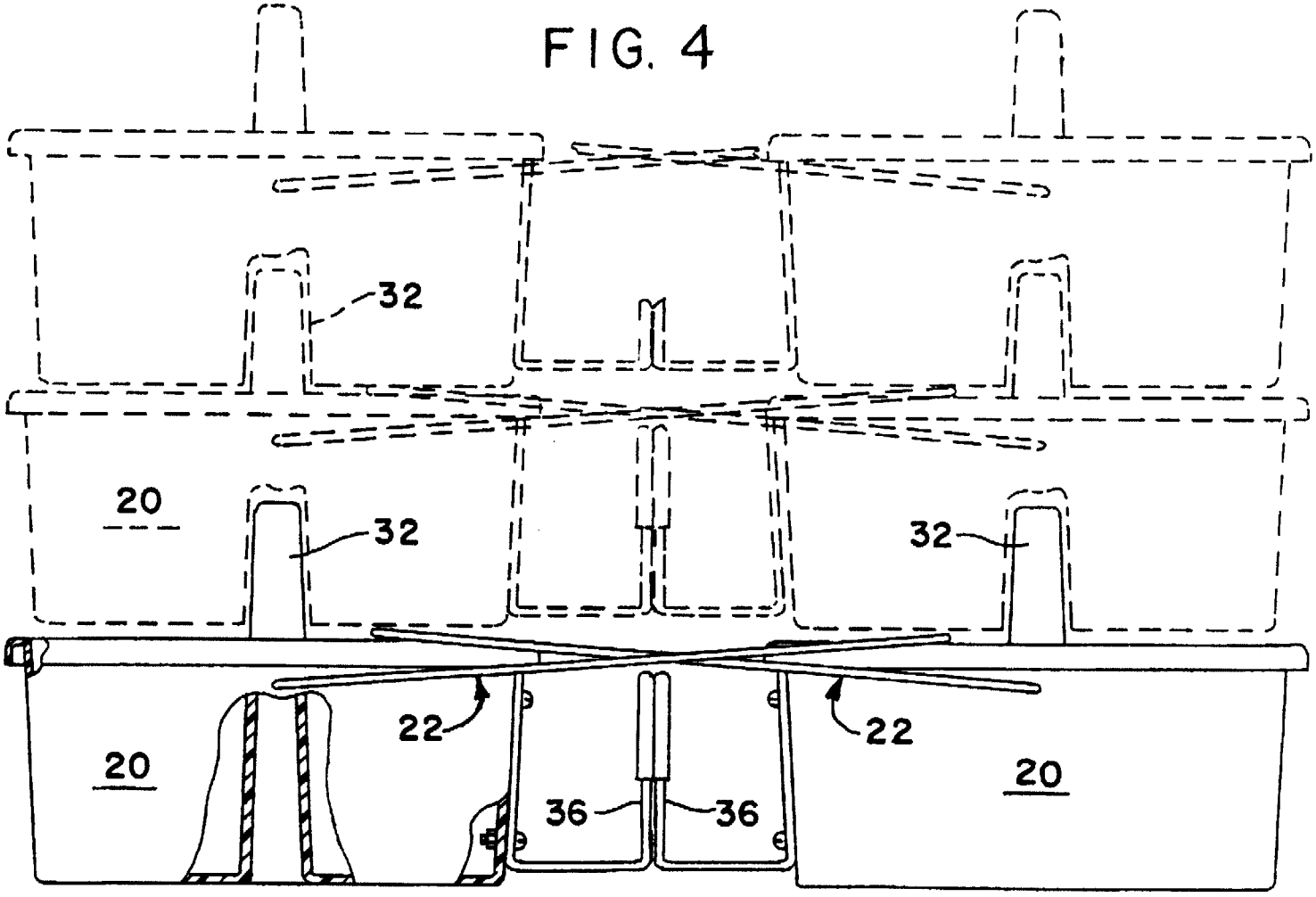
FIG. 4 is an elevational end view depicting a pair of baskets interlocked by means of their bails for side-by-side and vertically-stacked shipment.

A conventional stepladder 10 has a pair of front legs 12 and a pair of rear legs 14 hingedly connected together by a top platform 16 about which the rear legs 14 are pivoted. A pair of hinge braces 18, only one of which is shown, normally folds together when the ladder is in non-use condition, but is in its standard bracing use condition as shown in FIG. 1. Since the ladder itself is not part of the invention and is shown only to illustrate use of a utility basket 20, further description of the ladder is unnecessary, except to say that the usual ladder is approximately about 14 inches wide at its upper end. A bail 22 can be seen in FIG. 1 as holding the basket 20 firmly against the ladder 10 near its top end.

As seen more clearly in FIG. 2, the bail is generally U-shaped with essentially square corners, having a bottom 24 of the U of approximately fifteen to fifteen and one-half inches in length, and a pair of legs 26 extending from the ends of the bottom 24 toward the basket. Depending on the overall plan view dimensions of the basket 20 (which in the embodiment shown are approximately ten inches by fifteen inches), the length of the legs is determined by the position the basket 20 is intended to occupy at the top end of the ladder. The illustrated legs are twelve inches from the square corners of the U-shaped bail to inwardly-directed journaling ends 28 which pass through holes 30 which serve to journal the ends 28 relative to the basket 20. (See FIG. 3.). The preferred design of bail 22 and its relation to the basket 20 will be described in greater detail later.

The utility basket 20 is one which includes a centrally postioned carrying handle 32 extending lengthwise of the basket. The handle is of a width to enable easy carrying of the basket containing an offset load without tipping, such as might occur when carrying a heavy tool such as a power drill at one side or corner of the basket. As shown in dotted lines in FIG. 1, a pair of fluorescent lamps or light tubes 34 may be carried in upwardly-open U-shaped brackets 36 connected to the side of the basket 20 remote from the ladder 10. Depending on the length of the tubes (and therefore their weight), the basket would tend to tip downwardly toward the side supporting the tubes. By utilizing a sturdy handle 32 which is integral with the basket, tools and materials can be easily transported to and from the ladder 10 as needed without risk of tipping caused by an unbalanced load. The long side of basket 20 is of a length which is greater than the width of the standard spread of the rear legs 14 at the upper end of the ladder, so that the basket, when in the position shown in FIG. 1, contacts both legs 14. This provides for six-point suspension of the basket from the ladder 10, the basket contacting the legs 14 at its two bottom corners and two points where a rim 38 extends around the upper periphery of the basket, and also at two points where the bail 22 contacts the front edges of the front legs 12 of the ladder. Each point is actually in line contact with a ladder leg, providing for a very stable, non-tipping positioning of the basket 20 when supported on the ladder 10. Thus, the user can be free of concern of where in the basket a particular tool or material is placed. Of greater concern in the prior art baskets is dislodging of a basket or other support and the likely quick motion of the person to prevent it from falling from the ladder. Such quick motion has the potential of causing serious risk to the occupant of the ladder if he should slip as a result of trying to catch a basket which was falling or working loose.

A large varity of tools, materials, etc, can be carried in the basket, only three different types of which are shown. The already-described fluorescent tubes, a screwdriver and quart paint can are all shown in dotted lines. Obviously, various other kinds of fasteners, rags, paper towel rolls etc. can also be carried, merely providing that they fit within the space provided inside or hanging from outside the basket on the brackets 36. The basket 20 has the usual bottom to enable fasteners and small parts to be carried. Holes such as 37 may be provide in various locations in the basket 10 to receive screwdrivers. One screwdriver 40 is shown in dotted lines in FIG. 1 as it is being inserted into one of such holes in the direction of arrow 41. The space beneath the handle 32 is open for basket nesting purposes, as will be seen more clearly from FIG. 4. The basket is preferably injection-molded from an appropriate plastic, with the slan of the walls of the basket and the underside thereof being such as to enable common nesting. The slant of the side walls, particularly along the long side of the basket is such as to conveniently position the basket in horizontal or near-horizontal position when it is mounted on a standard ladder. An elastic strap 42 is provided about mid-way between the brackets 36 for holding fluorescent tubes against endwise slippage from the brackets during carrying, until they are ready to be installed. The strap may be fastened to the basket near its bottom and extend upwardly to a Velcro or other fastener at the top of the basket. As shown in FIG. 1, the elastic strap 42 is shown expanded about the tubes 34 even though the lamps are depicted in dotted lines. In FIG. 2, the strap is flat against its side wall, out of the way except when disconnected at its upper end and expanded to fasten around the lamps.

The journaling ends 28 of the bail 22 cause the bail to be suspended and swing freely below the basket 20 when the basket is being hand-carried from one place to another. When setting the basket down on a flat surface such as a bench or floor, the bail disposes pivotally to one side of the basket. When the basket 20 is carried in one hand by the handle 32 to a ladder, a person can climb the steps of the ladder while holding onto a ladder front leg 12 or a step 44 with his free hand, and simply position the basket in one motion over the top end of the ladder. With the basket 20 being raised to a height higher than the top platform 16, the bottom 24 of the U of the free-swinging pivotal bail 22 is made to contact the front edges of front ladder legs 12, the basket is then made to clear above and over the top platform 16 and is lowered to the level shown in FIG. 1. This is all done while the person is standing on the ladder steps and holding onto the ladder with the free hand. The basket and bail immediately settle until the six points of contact of the basket and bail with the ladder legs 12 and 14 occurs.

To enable the ease of installation and support just described, and further to enable baskets 20 to be connected in pairs as will be described in connection with FIG. 4, I prefer to spring-load the legs 26 of the bail inwardly toward the basket 20. This can be accomplished by making the angles where the legs 26 of the bail 22 join the bottom 24 at an acute angle, of perhaps eighty-seven degrees or so. The bail is made of a spring metal, approximately three-sixteenths of an inch in diameter. The ends of the legs adjacent the journaling ends 28 are positioned to contact the wall adjacent the hole 30. This means that the bail cannot be lifted above the rim 38 of the basket 20 unless the legs 26 are spread to their dotted-line positions as shown in FIG. 2. To accommodate this, lost motion is provided along each journaling end 28 between its leg 26 and a nut 46 snapped onto and gripping the inwardly-directed tip of the journaling end 28. The bail is shown in its normal inwardly-biased direction in solid lines in FIGS. 2 and 3, and in dotted lines with the bail legs 26 spread manually to allow the bail to be lifted and positioned above the rim 38. Normally, when the basket is initially placed over a ladder upper end, the bail 22 will lie beneath the rim 38 as shown in FIG. 1. If for any reason the basket will make better six-point contact with the ladder legs by having the legs 26 raised above the rim 38, the legs can be spread against the spring bias and angled upwardly from the position illustrated in FIG. 1.

In addition to the spring-loading function of the bail as described above, it serves another useful purpose when shipping multiple baskets from the manufacturer to the wholesaler or retailer. This is shown in FIG. 4 where a pair of baskets are placed together with their brackets 36 in contact, the bails crossing in interlocking fashion but catching beneath the rims 38 or their respective baskets due to the inward load of the spring material of the bail 22. In addition, if the brackets 36 are removed from the baskets at the time of shipment, the sides of the baskets will come into direct contact and the bails will cross similarly, be captured beneath the rims 38 but the bottoms of the U's will extend over and beyond the handle of the other basket. It can be seen that if the baskets are of the nesting type, they can be stacked vertically and made more compact for shipment in their customary containers. The handles will fit into the open space beneath the handle of the basket immediately above.

Various changes may be made without departing from the spirit and scope of the invention.

Having described my invention, I claim:

1. A utility basket adapted to be removably mounted over and adjacent the top end of a stepladder to provide support for tools and materials for use by a person standing on the ladder steps and performing work tasks therefrom;

said basket including a generally rectangular bottom wall having its longer sides essentially equal to the width of a stepladder on which it is to be mounted, a pair of opposed parallel side walls extending generally vertically upwardly from the bottom wall, a pair of opposed parallel end walls the same height as said side walls and extending generally vertically upwardly from the bottom wall, a ledge extending fully about the top edges of said side and end walls and protruding outwardly a short distance thereform to form a rim around the basket, and a relatively narrow manual carrying-handle extending centrally across the basket between the end walls and parallel to the side walls;

a journaling hole located immediately below said rim in each end wall, said holes being aligned with each other and with said handle;

a square-cornered and U-shaped bail having diametrically-opposed inwardly-directed journaling portions interfitting said journaling holes to provide a pivotal support of said basket relative to said bail;

the bottom of the U of said bail remote from the journaling portions extending parallel to said side walls and said U bottom being of a length slightly greater than the outside width of said stepladder;

a leg at each side of the U extending from a journaling portion to the adjacent end of the U bottom, said legs being of a length approximating the distance between the journaling holes in the basket to the side of the stepladder opposite the basket when the bail is pivoted for placement over the top of the stepladder to hold and maintain the basket in position for use when performing a work task; and, said bail being produced from a spring wire of a diameter and of sufficient rigidity to provide an inward biasing force between the ends of the legs adjacent the journaling portions when said legs are parallel, and the angle where each leg joins said U bottom being an acute angle whereby said legs at said journaling portions are positioned inwardly toward the end walls and said legs are maintained beneath said rim, requiring the legs to be spread outwardly manually to raise the bail above the rim for placement of the basket and bail over a stepladder.

2. A utility basket according to claim 1 wherein said end walls are relatively thin and said journaling holes pass entirely through said end walls, and further wherein the journaling portions of said bail extend inwardly of said ends walls a short distance sufficient to allow said bail legs to be spread for passage of the bail over the rim and said bail journaling portions to move axially within said journaling holes while being spread.

3. A utility basket according to claim 2 wherein said journaling portions of said bail each have a fastener on the inwardly extending end thereof to prevent the bail legs from disengaging their journaling portions from their respective holes except when assembling the bail to or disassembling it from the basket.

* * * * *